US007974559B2

(12) United States Patent
Lean et al.

(10) Patent No.: US 7,974,559 B2
(45) Date of Patent: Jul. 5, 2011

(54) DIRECT MARKING APPARATUS FOR SELECTIVELY PROVIDING POWDERED TONER PATCHES

(75) Inventors: Meng H Lean, Santa Clara, CA (US); Shu Chang, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 436 days.

(21) Appl. No.: 12/184,135

(22) Filed: Jul. 31, 2008

(65) Prior Publication Data

US 2010/0028055 A1 Feb. 4, 2010

(51) Int. Cl.
*G03G 15/08* (2006.01)

(52) U.S. Cl. ..... 399/266

(58) Field of Classification Search ..... 399/266, 399/265, 281, 289
See application file for complete search history.

(56) References Cited

U.S. PATENT DOCUMENTS

| | | | | |
|---|---|---|---|---|
| 6,175,707 | B1 * | 1/2001 | Eklund et al. | 399/265 |
| 6,219,515 | B1 * | 4/2001 | Lestrange | 399/289 |
| 6,246,855 | B1 * | 6/2001 | Gartstein et al. | 399/281 |
| 7,217,901 | B2 | 5/2007 | Lean et al. | |
| 7,293,862 | B2 | 11/2007 | Lean et al. | |
| 7,304,258 | B2 | 12/2007 | Lean et al. | |

* cited by examiner

*Primary Examiner* — Quana M Grainger
(74) *Attorney, Agent, or Firm* — Fay Sharpe LLP

(57) ABSTRACT

A marking apparatus including a traveling wave grid toner transport circuit structure for transporting powdered toner along a transport surface, and electric field concentrating elements for selectively enabling toner patches to be projected to an output medium by a projecting electric field.

24 Claims, 6 Drawing Sheets

DIRECT MARKING APPARATUS FOR SELECTIVELY PROVIDING POWDERED TONER PATCHES

CROSS REFERENCE TO RELATED APPLICATIONS

Cross reference is made to the following concurrently filed application, the disclosure of which is totally incorporated by reference herein: U.S. application Ser. No. 12/184,116, filed Jul. 31, 2008, now published as U.S. Publication No 2010-0028054-A1, and entitled "Powdered Toner Direct Marking Apparatus."

INCORPORATION BY REFERENCE

The following U.S. patents are specifically incorporated by reference herein: U.S. Pat. No. 7,217,901; U.S. Pat. No. 7,293,862; and U.S. Pat. No. 7,304,258.

BACKGROUND

The subject disclosure is generally directed to a direct marking apparatus, such as a printer or other hardcopy apparatus, that uses powdered toner as a marking component.

Conventional marking apparatus that use powdered toner as a marking component commonly employ electrostatographic techniques wherein an electrostatic latent image is lightwise formed on a photoconductive imaging surface and then developed by deposition of suitably electrically charged powdered toner on the photoconductive imaging surface. The developed image is transferred to an output medium (e.g., paper or other substrate), for example via a suitable transfer member such as a transfer belt or roll. After the transfer of the developed image to the output medium, the developed image is fixed, for example by application of pressure and/or heat.

Known powdered toner marking apparatus can be complex.

DETAILED DESCRIPTION

Figure 1:
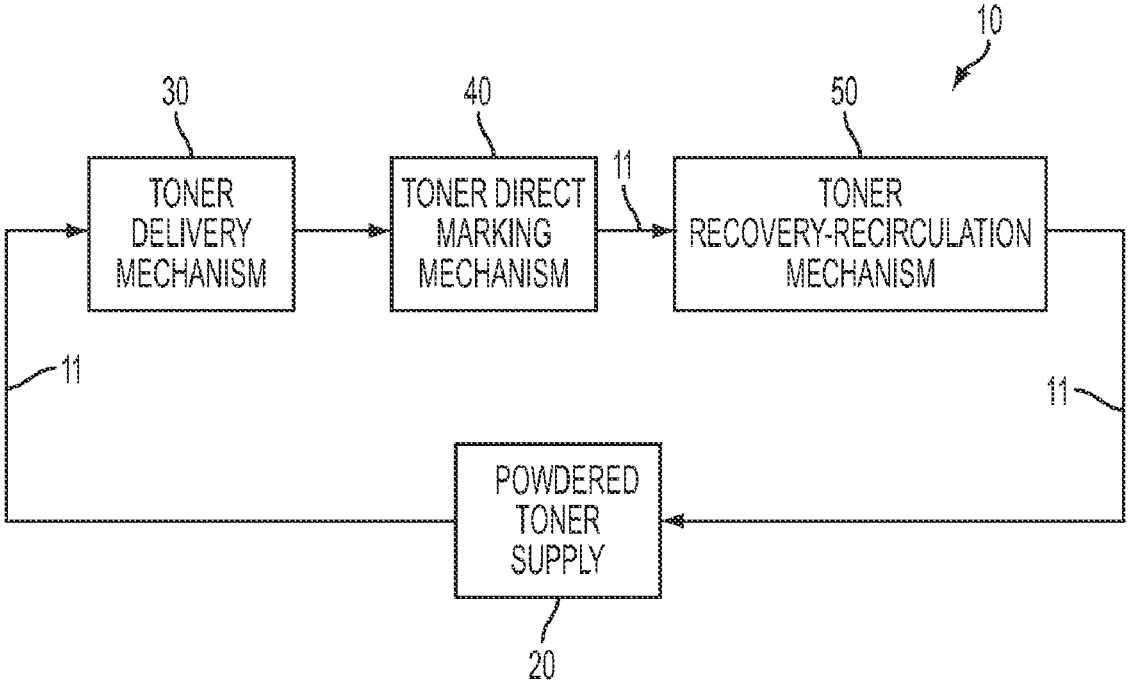
FIG. 1 is a schematic block diagram of a powdered toner direct marking system.

FIG. 1 is a schematic block diagram of a direct marking system 10 that includes in series a powdered toner feed or delivery mechanism 30, a powdered toner marking mechanism 40, and a powdered toner recovery or recirculation mechanism 50. The powdered toner feed mechanism receives or obtains suitably electrically charged powdered toner 11 from a powdered toner supply 20 and provides powdered toner to the feed mechanism 30 that in turn provides powdered toner to the marking mechanism 40. The toner recovery mechanism 50 can return unused powdered toner to the toner supply 20, for example, for reuse by recirculation.

As more particularly described herein, the feed mechanism 30, the marking mechanism 40 and the recovery mechanism can comprise portions of a traveling wave grid that cooperate to transport a powdered toner cloud through the marking mechanism, and are configured to control the height or shape of the powdered toner cloud. The marking mechanism 40 is more particularly configured to selectively release and project patches of powdered toner (of controlled thickness, for example) to an output medium 81, wherein the patches of powdered toner generally comprise relatively small amounts of powdered toner. The propelled toner patches can also be called pixels for convenience. In that regard, the feed mechanism 30, the marking mechanism 40 and the recovery mechanism 50 can be more particularly configured to prevent the transported powdered toner from coming into contact with an output medium except as commanded by the print mechanism 40.

Figure 2:
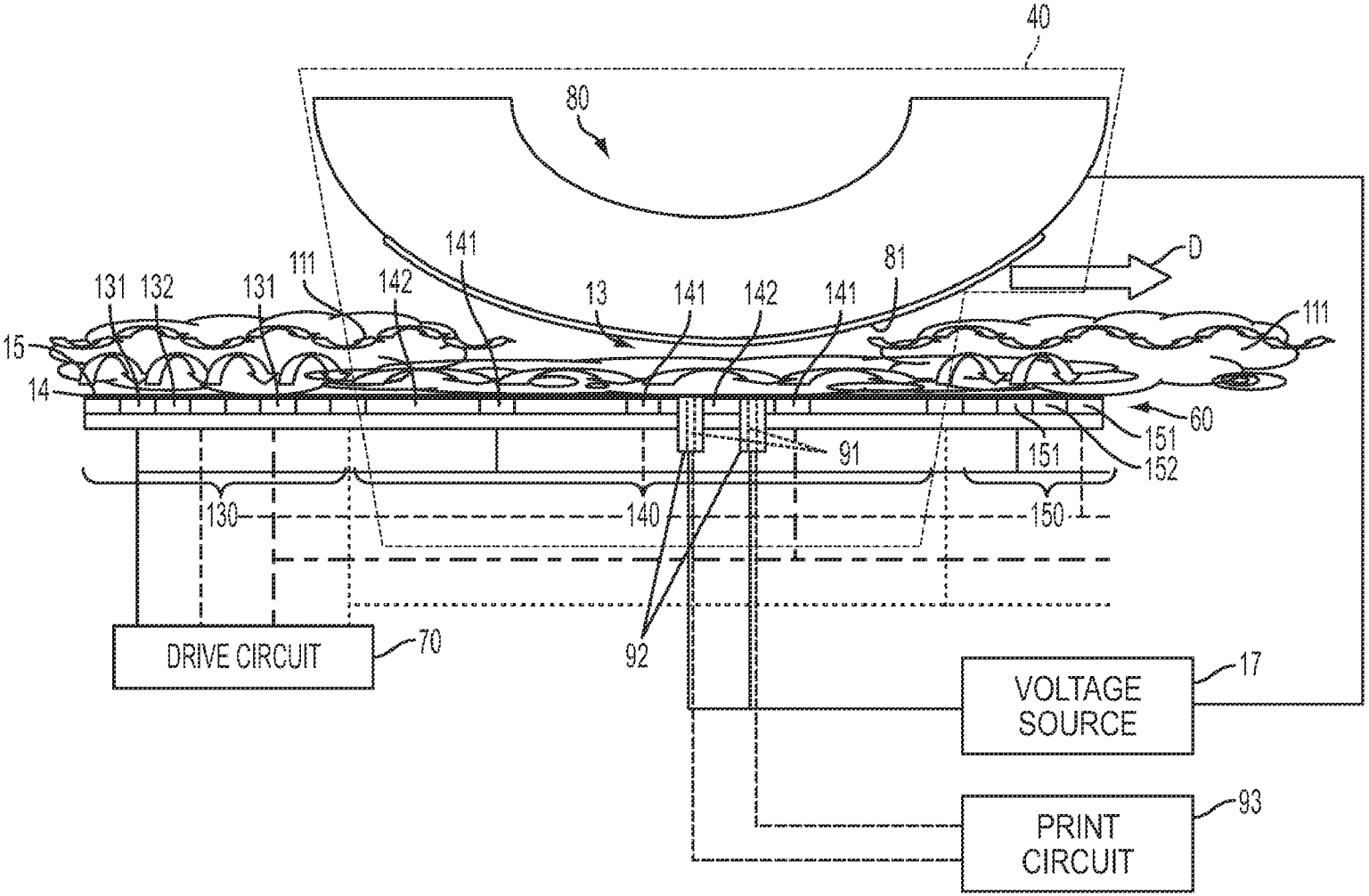
FIG. 2 is a schematic block diagram of a powdered toner direct marking system that includes a traveling wave grid circuit structure.

FIG. 2 is a block diagram of a direct marking system wherein the powdered toner feed mechanism 30, the powdered toner marking mechanism 40 and the powdered toner recovery mechanism 50 comprise serially adjoining regions or portions 130, 140, 150 of a traveling wave grid circuit structure 60 that is suitably driven by a drive circuit 70.

The traveling wave grid feed portion 130 includes electrodes or conductive traces 131 and spacers 132, the traveling wave grid marking portion 140 includes electrodes or conductive traces 141 and spacers 142, and the traveling wave grid extraction portion 150 includes electrodes or conductive traces 151 and spacers 152. The traveling wave grid circuit structure further includes a thin electrically insulating outer layer 14 that overlies the electrodes 131, 141, 151 and the spacers 132, 142, 152, and provides an electrically insulated transport surface 15.

The marking mechanism 40 further includes a receiver structure 80 that is adjacent the traveling wave grid marking portion 140 and separated therefrom by a gap 13. The receiver structure 60 suitably supports an output medium 81 such a receiver substrate generally oppositely the traveling wave grid portion 140. The output medium 81 can comprise a hardcopy substrate such as paper or film, or a transfer coating, for example.

The traveling wave circuit structure 60 is configured to transport a powdered toner cloud 111 along the transport surface 15 from the feed region 130 to the marking region 140 to the recovery region 150, generally along a transport direction D. The traveling wave grid circuit structure 60 is further configured to control the height of the powdered toner cloud such that it does not come into contact with the output medium 81 and produce unwanted development or marking. For example, the traveling wave grid marking portion 140 is configured to produce an electric field that is flatter than the electric fields produced by the grid regions 130, 150, so as to allow the toner cloud to "duck" as it passes through the narrow part of the gap 13 without contacting the output medium 81 (except as commanded by other components of the marking mechanism described further herein). This can be accomplished, for example, by appropriately selecting the pitch or spacing of the traces 141 of the traveling wave grid marking region 140 and/or selecting the material of the spacers 142 of the traveling wave grid marking region 140. For example, the pitch or spacing of the traces 141 of the traveling wave grid marking region 140 can be greater than the spacing of the traces 131, 151 of the traveling wave grid feed and extraction regions 130, 150. As a further example, the spacers 142 of the traveling wave grid marking region 140 can comprise a finite conductivity material (i.e., electrically resistive) such as carbon impregnated rubber while the spacers 132, 152 of the traveling wave grid feed and extraction regions 130, 150 can comprise dielectric material. The finitely conductive spacers 142 (which can be formed of resistive film, for example) function to conduct a surface current which allows for a linear lateral drop of the surface voltage. The electric field is flattened to lie on the surface of the finitely conductive spacers. Toner follows the field lines and therefore transit the gap in sliding contact with the transport surface 15 of the thin outer layer 14. The electric field generated by the traveling wave grid marking region 140 supports a few particle layers of toner that adhere to the transport surface by van der Waals adhesion. In other words, toner is transported over the traveling wave grid marking region 140 as a sheet or carpet of toner of controlled thickness.

By way of illustrative example, the traveling wave grid 60 can comprise conductive traces and intervening spacers of suitable composition deposited or printed on a non-conductive substrate such as a polyamide layer. The conductive traces and the spacers can be covered with a Tedlar or Kapton film that can form the electrically insulating outer layer 14.

Figure 3:
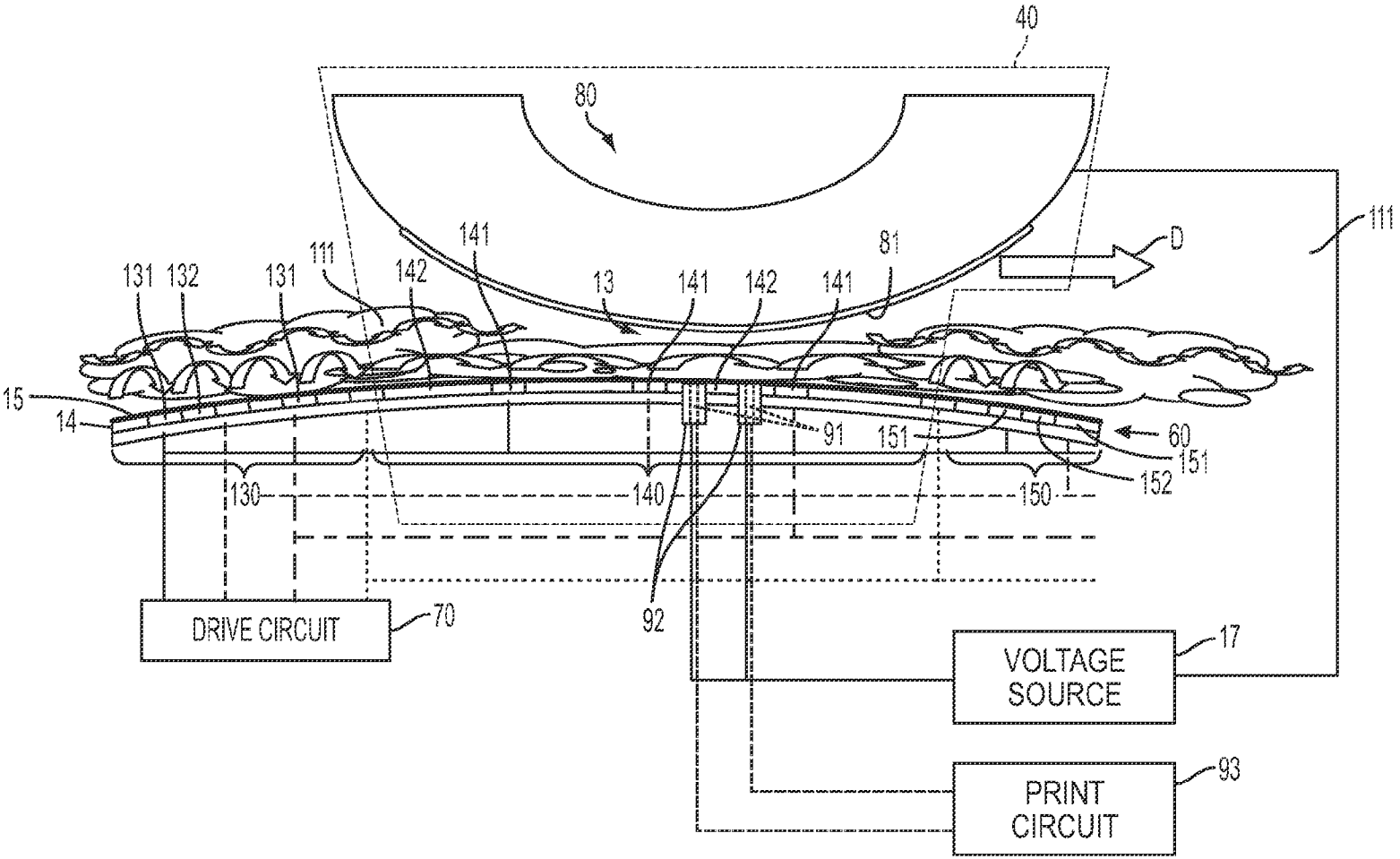
FIG. 3 is a schematic block diagram of an arcuately shaped traveling wave grid circuit structure that can be employed in the direct marking system of FIG. 2.

By way of further illustrative examples, the traveling wave grid can be generally planar or arcuate (as schematically depicted in FIG. 3).

The marking mechanism 40 further includes electric field concentrator and electric field generating components for releasing patches of powdered toner and projecting released toner patches onto the output medium 81. For example, the marking mechanism includes an array 90 of addressable insulated electrically conductive pins 91 that pass through one or more finitely conductive spacers 142 so as to extend to but not through the electrically insulating outer layer 14. The conductive pins 91 are electrically insulated from the associated finitely conductive spacer 142 by a suitable insulation layer 94, and are selectively addressably driven (e.g., pulsed) by a print drive circuit 93 to release or detach toner patches from the portion of the toner cloud or sheet adjacent the electrically conductive pins 91. The released toner patches are projected or accelerated to the output medium 81 by a projecting DC electric field generated by a circuit that includes a DC voltage source 17, the receiver structure 80, and the electrically conductive pins 91. For example, the voltage source 17 biases the portion of the receiver structure 80 adjacent the back of the output medium 81 with respect to the electrically conductive pins 91 using a voltage of opposite polarity to attract the released toner patches. The projecting electric field is constantly on and by itself is below the detachment threshold or insufficient to electrostatically detach toner from the relatively thin toner cloud sheet traveling over the traveling wave grid marking region 140. In this manner, the toner sheet is biased at a DC voltage level that is below the detachment voltage.

Figure 4:
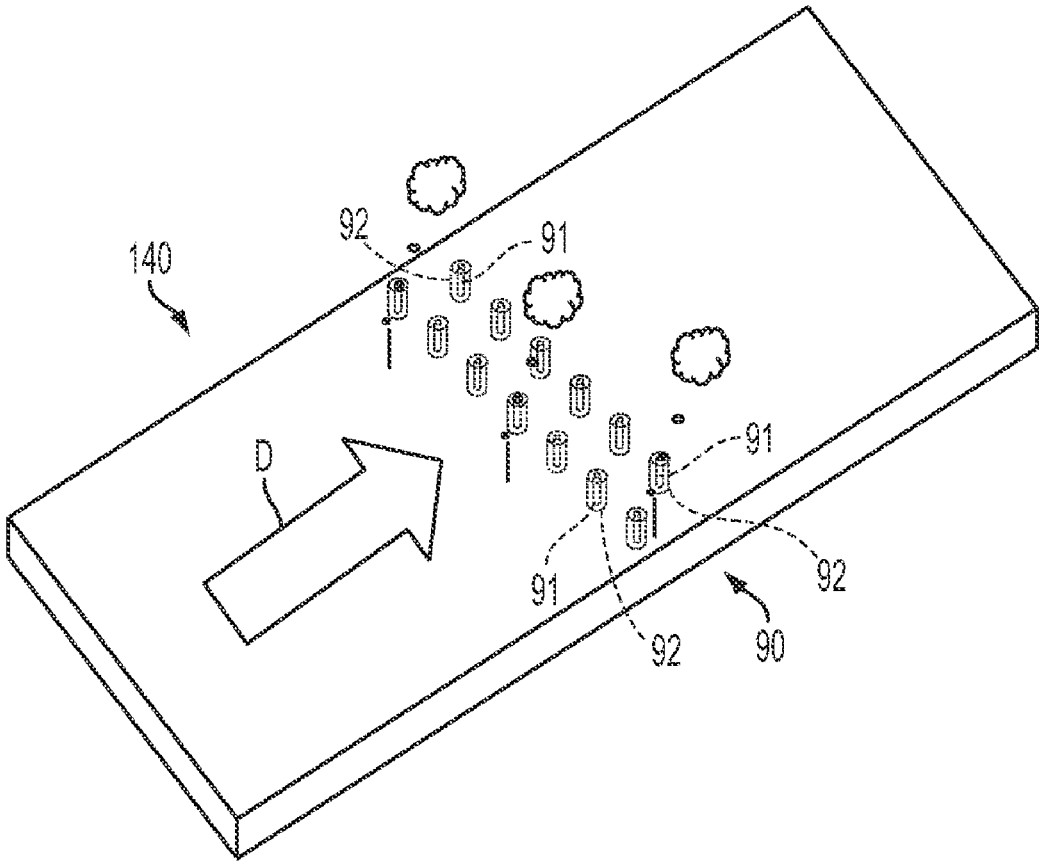
FIG. 4 is a schematic perspective view of a portion of the marking mechanism of the direct marking system of FIG. 3 showing electric field concentrating marking elements.
Figure 5:
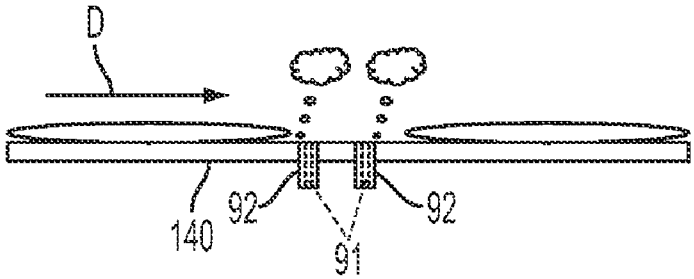
FIG. 5 is a schematic elevation view of the portion of the marking mechanism depicted in FIG. 4.

The electrically conductive pins 91 can be arranged in one or more rows oriented generally transverse to the toner transport direction D, as generally depicted in FIGS. 4 and 5. In conjunction with such an array of toner releasing electrically conductive pins, the receiver output medium 81 can be scanned or translated parallel to the toner transport direction D relative to the transport surface of the traveling wave grid circuit structure 15, for example continuously or incrementally, such that a two dimensional pixel array on the output medium can be selectively marked with powdered toner patches. Employing a plurality of staggered rows of electrically conductive pins 91 can provide for increased pixel resolution.

By way of illustrative example, the electrically conductive pins have a cross section that is less than the desired pixel size and are driven in a manner that in the presence of the projecting electric field causes patches of toner to overcome van der Waals adhesion and be released or detached from the toner sheet and projected across the gap 13 by the projecting field.

Figure 6:
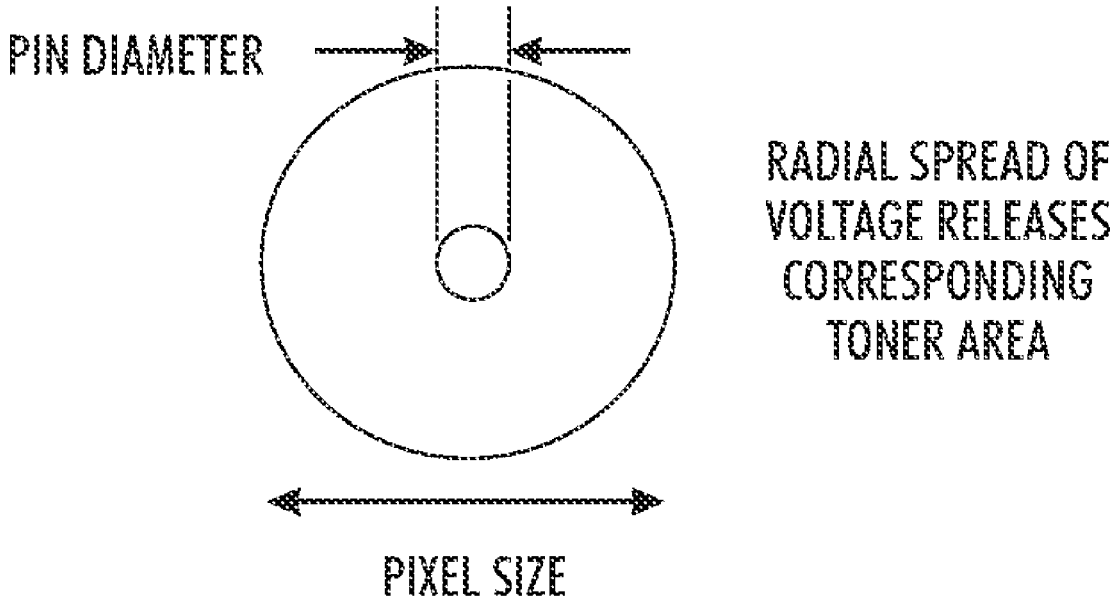
FIG. 6 is a schematic depiction of a toner release area generated by the radial spread of a voltage pulse applied to a conductive pin of the direct marking system of FIGS. 2 and 3.
Figure 7:
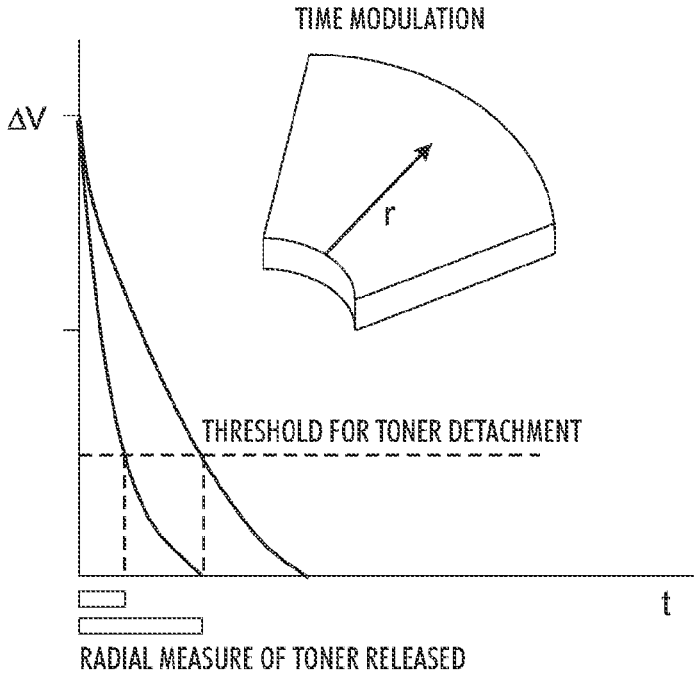
FIG. 7 is a schematic depiction of the radial voltage profile for a pre-set ΔV and two pulse widths. The vertical dashed lines are the intersections of the voltage profile with the detachment voltage threshold, and qualitatively denote the radial extent of the toner detached from the toner sheet due to the respective pulse widths.
Figure 8:
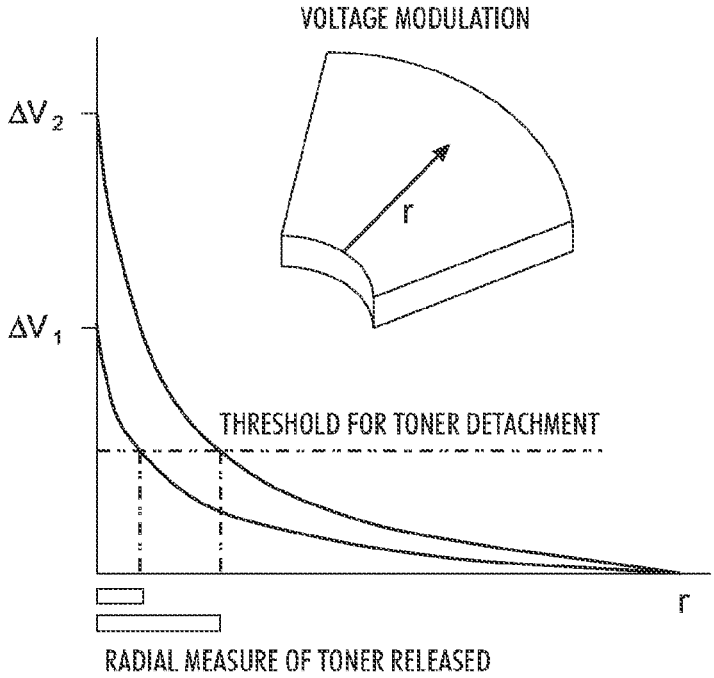
FIG. 8 is a schematic depiction of the radial voltage profile for a pre-set pulse width but two different amplitudes for ΔV. The vertical dashed lines are the intersections of the voltage profile with the detachment voltage threshold, and denote the radial extent of the corresponding circular toner patch toner detached from the toner sheet.

Referring now to FIGS. 6-8, the amount of toner released can be measured by controlling a toner release area which is a function of the radial spread of the surface voltage in the finite conductivity spacer 142 when a conductive pin is pulsed. In particular, FIG. 6 shows the toner release area that corresponds to that region which attains a voltage (positive or negative, depending on the charge of the powdered toner) that exceeds the threshold or detachment voltage and is therefore sufficient to release toner from the toner sheet. Thus, each pin can be individually addressed with an incremental voltage, $\Delta V$, which together with the DC bias exceed the threshold in order to release toner.

Since the toner release area depends on radial voltage spread, the electrically conductive pins can be pulsed in such a manner as to control the volume or amount of toner in each of the toner patches that are released, and in this manner gray scale printing can be accomplished.

More particularly, the electrically conductive pins can be selectively driven in a time modulated (e.g., pulse width) and/or voltage (i.e., amplitude) modulated manner. The time modulation mode represented in FIG. 7 may be affected, for example, by applying a pre-set incremental voltage (i.e., constant amplitude or magnitude) for varying pulse durations or widths to release toner proportional to the area corresponding to the expanding annular region due to the radial spread of the pulse. The voltage modulation mode represented in FIG. 8 may be affected, for example, by applying varying voltage magnitudes having the same pre-set pulse width (i.e., constant pulse width) to induce radial spread of the applied voltage to detach toner in the area where the total voltage exceeds the threshold for detachment.

The finitely conductive spacer 142 that is associated with an insulated conductive pin 91 can more particularly be designed for the desired print speed, for example for an RC spread time that is shorter than the latency between printed pixels. The effective resistance R of a finitely conductive spacer is:

$$R=\rho(r-a_o)2\pi rh,\ a_o \leqq r \leqq a$$

wherein:

R is the resistance at radial distance r from the center of the conductive pin 91;

$\rho$ is the resistivity of the finitely conductive spacer 142;

r is radial distance measured from the center of a conductive pin 91;

$a_o$ is the radius of a conductive pin 91;

a is the outer radius of the pixel; and h is the thickness of the finely conductive spacer 142.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A marking apparatus comprising:

a traveling wave grid toner transport circuit structure having in series a feed portion, a marking portion, and a recirculation portion, the traveling wave grid toner transport structure including:

a generally continuous transport surface;

a plurality of spaced apart electrodes included on the marking portion; and a resistivity layer included on the marking portion;

the transport circuit structure being configured to support a powdered toner cloud that adheres to the transport surface by van der Waals adhesion and transport the powdered toner cloud along the transport surface generally along a transport direction;

a receiver having a receiver surface adjacent and separated by a gap from the transport surface of the marking portion of the transport circuit structure;

a circuit for generating a projection electric field in the gap between the receiver surface and the transport surface;

a plurality of electric field concentrating elements located in the marking portion of the transport circuit structure, the electric field concentrating elements adapted to be selectively driven to release patches of toner from a portion of the toner cloud such that the selectively released toner patches overcome the adhesion and are projected across the gap by the projecting electric field;

the traveling wave grid toner transport structure being configured to prevent toner from contacting the receiver surface except for the toner patches released by the electric field elements; and the projecting electric field being insufficient to cause transfer of toner to the receiver surface except when released by the electric field concentrating elements.

2. The marking apparatus of claim 1 wherein the spacing between electrodes in the marking portion is configured to produce an electric field that is flatter than the electric fields produced by the feed and extraction portions.

3. The marking apparatus of claim 1 wherein the marking portion of the traveling wave grid toner transport circuit structure includes a plurality of electrodes spaced apart by finitely conductive spacers.

4. The marking apparatus of claim 1 wherein the electric field concentrating elements are addressable.

5. The marking apparatus of claim 1 wherein the electric field concentrating elements are arranged in staggered rows.

6. The marking apparatus of claim 1 wherein the electric field concentrating elements comprise electrically conductive pins.

7. The marking apparatus of claim 1 wherein the electric field concentrating elements comprise electrically conductive pins having a cross-sectional area that is smaller than a desired area of each of the released toner patches.

8. The marking apparatus of claim 1 wherein the electric field concentrating elements comprise electrically conductive pins that are pulsed in such a manner as to control the volume of each of the toner patches that are released.

9. The marking apparatus of claim 1 wherein the electric field concentrating elements comprise electrically conductive pins that are pulsed in a time modulated manner.

10. The marking apparatus of claim 1 wherein the electric field concentrating elements comprise electrically conductive pins that are pulsed in a voltage modulated manner.

11. A marking apparatus comprising:

a traveling wave grid toner transport circuit structure, including:

a plurality of spaced apart electrodes, spacers situated between the electrodes, the spacers in a marking region of the traveling wave grid toner trans sort circuit structure being adapted to drop surface voltage of a projection electric field, and a transport surface overlying the electrodes and the spacers;

a receiver having a receiver surface adjacent and separated by a gap from the transfer surface;

a circuit for driving the electrodes to generate the projection electric field in the gap between the receiver surface and the transport surface, the projection electric field being adapted to transport the powdered toner cloud in a transport direction along the transport surface;

a plurality of electric field concentrating elements passing through the spacers in the marking region for selectively enabling toner patches to be released from the toner cloud and projected across the gap by the projecting electric field;

the traveling wave grid toner transport structure being configured to prevent toner from contacting the receiver surface except as selectively released by the electric field elements.

12. The marking apparatus of claim 11 wherein the spacing between electrodes in a marking portion of the traveling wave grid toner transport structure is configured to prevent toner from contacting the receive surface except as selectively released by the electric field elements.

13. The marking apparatus of claim 11 wherein the traveling wave grid toner transport circuit structure includes a plurality of electrodes spaced apart by finitely conductive spacers.

14. The marking apparatus of claim 11 wherein the electric field concentrating elements are addressable.

15. The marking apparatus of claim 11 wherein the electric field concentrating elements are arranged in staggered rows.

16. The marking apparatus of claim 11 wherein the electric field concentrating elements comprise electrically conductive pins.

17. The marking apparatus of claim 11 wherein the electric field concentrating elements comprise electrically conductive pins having a cross-sectional area that is smaller than a desired area of each of the released toner patches.

18. The marking apparatus of claim 11 wherein the electric field concentrating elements comprise electrically conductive pins that are pulsed in such a manner as to control the volume of each of the toner patches that are released.

19. The marking apparatus of claim 11 wherein the electric field concentrating elements comprise electrically conductive pins that are pulsed in a time modulated manner.

20. The marking apparatus of claim 11 wherein the electric field concentrating elements comprise electrically conductive pins that are pulsed in a voltage modulated manner.

21. A powdered toner jetting system comprising:

means for moving a sheet of powdered toner along a transport surface;

receiving means spaced by a gap from the transport surface;

means for generating a toner projecting electric field in the gap;

means for dropping a voltage of a surface current situated in a marking region of the transport surface; and means for selectively releasing toner from portions of the toner sheet at the marking region.

22. A method of printing comprising:

providing an electric field for transporting a powdered toner sheet along a transport surface overlying a plurality of spaced apart electrodes;

dropping a voltage in a surface current using spacers situated between the electrodes of a marking region; and selectively driving electric field concentrating elements passing through the spacers of the marking region to enable small amounts of toner to be propelled from the toner sheet to an output medium.

23. The method of claim 21 wherein selectively driving electric field concentrating elements comprises selectively pulsing electrically conductive pins to enable the small amounts of toner to be released and propelled by the electric field to the output medium.

24. The method of claim 21 further including selectively spacing the spacers to control a height of the powdered toner sheet.

* * * * *

UNITED STATES PATENT AND TRADEMARK OFFICE

CERTIFICATE OF CORRECTION

PATENT NO. : 7,974,559 B2
APPLICATION NO. : 12/184135
DATED : July 5, 2011
INVENTOR(S) : Meng H. Lean and Shu Chang It is certified that error appears in the above-identified patent and that said Letters Patent is hereby corrected as shown below:

On the title page, item (73) should read:

(73) Assignee: Xerox Corporation, Norwalk, CT (US)
Palo Alto Research Center Incorporated, Palo Alto, CA (US)

Signed and Sealed this
Twenty-fifth Day of October, 2011

David J. Kappos

David J. Kappos
*Director of the United States Patent and Trademark Office*